US006095832A

United States Patent [19]

Kusuhara et al.

[11] Patent Number: 6,095,832

[45] Date of Patent: Aug. 1, 2000

[54] CAP HOUSING FOR ELECTRICAL CONNECTORS

[75] Inventors: Toshitaka Kusuhara, Kanagawa; Shuji Kajinuma, Yamato, both of Japan

[73] Assignee: The Whitaker Corporation, Wilmington, Del.

[21] Appl. No.: 09/043,778

[22] PCT Filed: Sep. 30, 1996

[86] PCT No.: PCT/US96/15560

§ 371 Date: Mar. 24, 1998

§ 102(e) Date: Mar. 24, 1998

[87] PCT Pub. No.: WO97/12426

PCT Pub. Date: Apr. 3, 1997

[30] Foreign Application Priority Data

| | | | |
|---|---|---|---|
| Sep. 19, 1995 | [JP] | Japan | 7-253691 |
| Jul. 19, 1996 | [JP] | Japan | 8-200538 |

[51] Int. Cl.[7] ..... H01R 13/44

[52] U.S. Cl. ..... 439/135

[58] Field of Search ..... 439/135, 940, 439/36, 630, 138, 637

[56] References Cited

U.S. PATENT DOCUMENTS

| | | | |
|---|---|---|---|
| 3,386,071 | 5/1968 | Allen | 339/36 |
| 3,407,264 | 10/1968 | Cull | 174/138 |
| 4,273,400 | 6/1981 | Porsch et al. | 339/36 |
| 4,795,354 | 1/1989 | Owen | 439/630 |
| 5,026,295 | 6/1991 | Fong et al. | 439/135 |
| 5,242,311 | 9/1993 | Seong | 439/135 |
| 5,249,977 | 10/1993 | Tanaka et al. | 439/135 |
| 5,361,492 | 11/1994 | Miyazawa | 29/879 |
| 5,507,657 | 4/1996 | Seto et al. | 439/135 |
| 5,558,540 | 9/1996 | Kato et al. | 439/637 |
| 5,651,684 | 7/1997 | Northey et al. | 439/41 |
| 5,681,174 | 10/1997 | Correll et al. | 439/135 |
| 5,688,133 | 11/1997 | Ikesugi et al. | 439/135 |
| 5,746,611 | 5/1998 | Brown et al. | 439/135 |
| 5,756,937 | 5/1998 | Gleadall | 439/135 |
| 5,899,760 | 5/1999 | Ho et al. | 439/135 |

FOREIGN PATENT DOCUMENTS

| | | | |
|---|---|---|---|
| 0 060 644 | 9/1982 | European Pat. Off. | H01R 13/438 |
| 0 548 583 A1 | 6/1993 | European Pat. Off. | H05K 13/04 |
| 2 587 846 | 3/1987 | France | H01R 9/09 |
| 86 32 373 | 3/1987 | Germany | H01R 13/52 |

*Primary Examiner*—Steven L. Stephan
*Assistant Examiner*—Chandrika Prasad

[57] ABSTRACT

A cap housing (30,130,300,400,500) for mounting electrical connectors (80,180,380,480,580,680) thereto comprises cap portions (40,60,140,160,310,410,511,512) for receiving mating sections of connector housings containing contact portions **(84*b*,184*b*,384,484,584,684) of electrical contacts (84,184,383,483,583,683) for protecting the contact portions, the mounting sections of the connector housings containing tine portions (84*a*,184*a*,386,486,586,686) that are to be positioned on a circuit board and soldered thereto, and engaging members (48,68,148,168,313,420,513,514)** of the cap portions for engaging the electrical connectors thereby maintaining the electrical connectors on the cap portions.

18 Claims, 15 Drawing Sheets

CAP HOUSING FOR ELECTRICAL CONNECTORS

FIELD OF THE INVENTION

The present invention relates to a cap housing for electrical connectors to be used when transporting or mounting electrical connectors.

BACKGROUND OF THE INVENTION

Conventionally, electrical connectors are widely used to be mounted on a printed circuit board (PCB) for interconnecting the PCB and other electrical circuits. This type of electrical connector comprises contacts having tine portions to be inserted into throughholes or onto solder pads of a printed circuit board and contact portions engaging with contact of a matable connector, and a housing having the contacts disposed therein. In installing such electrical connectors on a circuit board, it is typical to pick up each electrical connector by a robot or the like for mounting it on the printed circuit board by inserting the tine portions into the throughholes or onto the solder pads of the printed circuit board before soldering thereto.

Flux is generally accompanied with the soldering operation, which may flow onto the contact portions of the contacts, thereby resulting in defective electrical engagement with the corresponding contact in the matable connector. This means that attention must be paid in soldering so that no foreign materials are located on the contact portions of the contacts.

European Publication No. 0 060 644 discloses a cover that is removably mounted on an electrical connector housing in which electrical contacts are retained, the cover includes a contact-engaging section that extends into a cavity of the connector housing and engages contact sections of the electrical contacts whereby the cover serves as a tool against which a force is applied to drive post sections of the electrical contacts into through holes of a circuit board.

European Publication No. 0 0548 583 discloses a cover for automatically mounting electrical connectors to a circuit board by a vacuum-suction nozzle wherein the cover includes a top plate to which the vacuum-suction nozzle can be applied, and flexible arms of the cover include hooks that engage opposing walls of a connector housing. The top plate extends over pin-like terminals projecting from an upper surface of the connector housing.

SUMMARY OF THE INVENTION

In consideration of the above situation, it is a feature of the present invention to provide a cap housing for electrical connectors capable of easily keeping any dust or foreign material away from the contact portions of the contacts during installation of the connectors on a printed circuit board or transportation of the electrical connectors. An additional feature of the present invention is to provide a cap housing for electrical connectors capable of accurately and simultaneously aligning a plurality of electrical connectors on a printed circuit board.

In order to achieve the above features, a first cap housing for an electrical connector according to the present invention comprises a connector housing having a bottom surface and a top surface located in opposed relation to the bottom surface, and contacts to be disposed in the connector housing and having tine portions located at the bottom surface to be mounted on a printed circuit board and contact portions adjacent to the top surface for engaging with contacts in a matable connector. The cap housing for the electrical connector has a plurality of integral cap portions for removably mounting on the connector housing and covering the top surface and the contact portions of the electrical connector to be disposed in the cap housing.

A second cap housing for an electrical connector to achieve the above features is a cap housing for an electrical connector having a mating portion near the top surface to mate with a matable connector, and contacts disposed in the mating portion for engagement with contacts in the matable connector, the cap housing for the electrical connector being mounted on the electrical connector to cover the mating portion with the bottom surface facing the circuit board. It features the provision of engaging projections to engage with the contacts of the electrical connector when mounted thereon.

Also, a third cap housing for an electrical connector according to the present invention to achieve the above features is mounted on an electrical connector to cover a mating portion near the top surface for mating with a matable connector and to be mounted with the bottom surface facing a circuit board. The cap housing for the electrical connector features the provision of not only a first cap portion at one side to cover a mating portion of an electrical connector having a male type mating portion but also a second cap portion to cover a mating portion of an electrical connector having a female type mating portion.

The invention is a cap housing for mounting electrical connectors thereto for protecting contact portions of electrical contacts secured in connector housings and for positioning the tine portions of the electrical contacts onto circuit boards so that the tine portions can be soldered to the circuit boards, wherein the cap housing includes cap portions for receiving mating sections of the connector housings containing the contact portions with the mounting sections of the connector housings containing the tine portions for positioning on a circuit board, and engaging members of the cap portions for engaging the electrical connectors thereby maintaining the electrical connectors on the cap portions.

Embodiments of the invention will now be described by way of example in accordance with the following description with reference to the accompanying drawings after drawings:

DETAIL DESCRIPTION OF AN EMBODIMENT OF THE INVENTION

Figure 1:
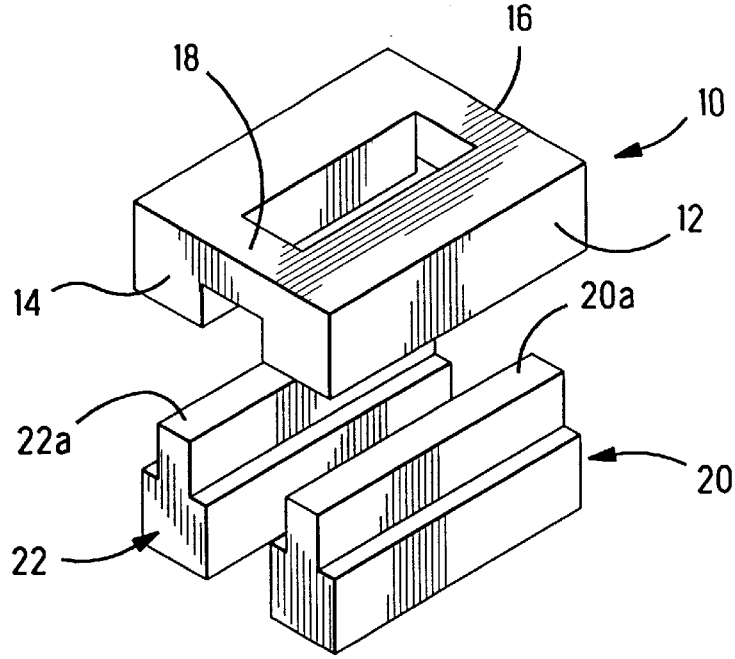
FIG. 1 is an isometric exploded view of a simplified version of a first embodiment of a cap housing and electrical connectors according to the present invention.
Figure 2:
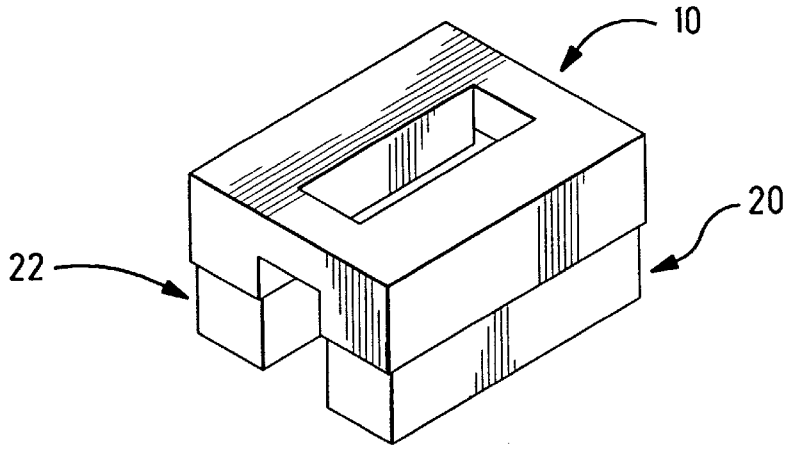
FIG. 2 is a view similar to FIG. 1 showing the cap housing and connectors in an assembled condition.
Figure 3:
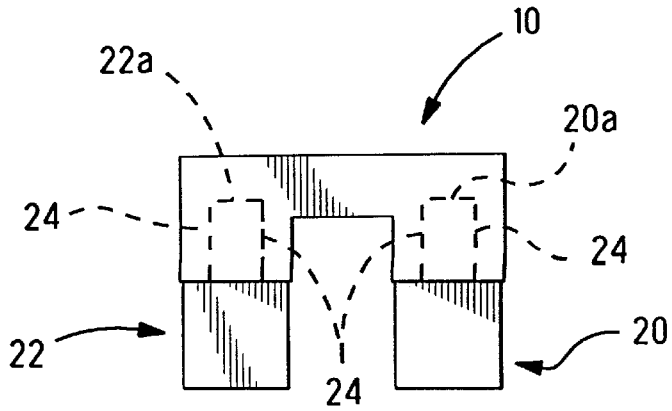
FIG. 3 is an end view of the assembly of FIG. 2.

The particular cap housing 10 of FIGS. 1 to 3 for electrical connectors is formed with a pair of parallel spaced-apart cap portions 12,14 which are integrally made by molding from, for example, a suitable plastic material with spaced apart ribs 16,18 intercoupling the spaced cap portions 12,14 at both ends. The cap portions 12,14 are designed to be removably mounted on connector housing 20,22 of respective electrical connectors. When the cap portions 12,14 are mounted on the housings 20,22, the top surfaces 20*a*,22*a* of the housings 20,22 as well as contact portions 24 of electrical contacts are covered as best shown in FIG. 3. As a result, when mounting on a circuit board (not shown) or transporting the electrical connectors having the housings 20,22, the top surfaces 20*a*,22*a* of the housings 20,22 and the contact portions 24 of the contacts are protected by the cap housing 10 for the electrical connectors, thereby keeping any dust or other foreign material away from the contact portions 24 of the contacts. Furthermore, the two cap portions 12,14 of the cap housing 10 hold a pair of electrical connectors simultaneously for mounting on a circuit board or transportation. It is to be noted here that the above description is made regarding the cap housing 10 for electrical connectors which is formed with a pair of parallel cap portions 12,14; however, more than two cap portions may be formed. Also, the two cap portions 12,14 may be arranged in a V-shape or three cap portions may be arranged integrally in a U-shape depending on the particular arrangement of how the electrical connectors are to be mounted on a circuit board.

Reference is now made to FIGS. 4 through 13 to describe the first embodiment of the cap housing for electrical connector according to the present invention.

Shown in FIGS. 4 through 13 is the cap housing 30 for electrical connectors. The cap housing 30 comprises two parallel cap portions 40,60 which are formed integrally and formed with spaced ribs 32 at both ends. Additionally, both cap portions 40,60 are coupled together with additional spaced ribs 34 for better alignment of the cap portions 40,60 and preventing the cap portions from warping.

Figure 4:
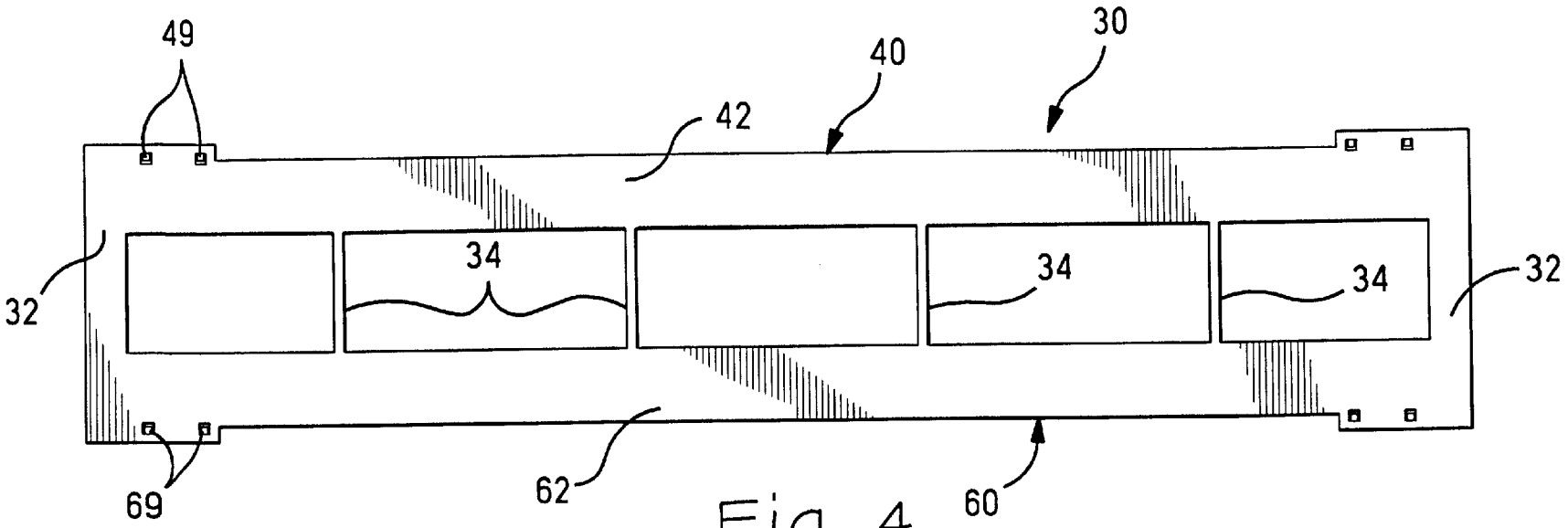
FIGS. 4 to 7 are top plan, side, bottom and end views respectively of a first embodiment of the cap housing of FIGS. 1 to 3.
Figure 5:
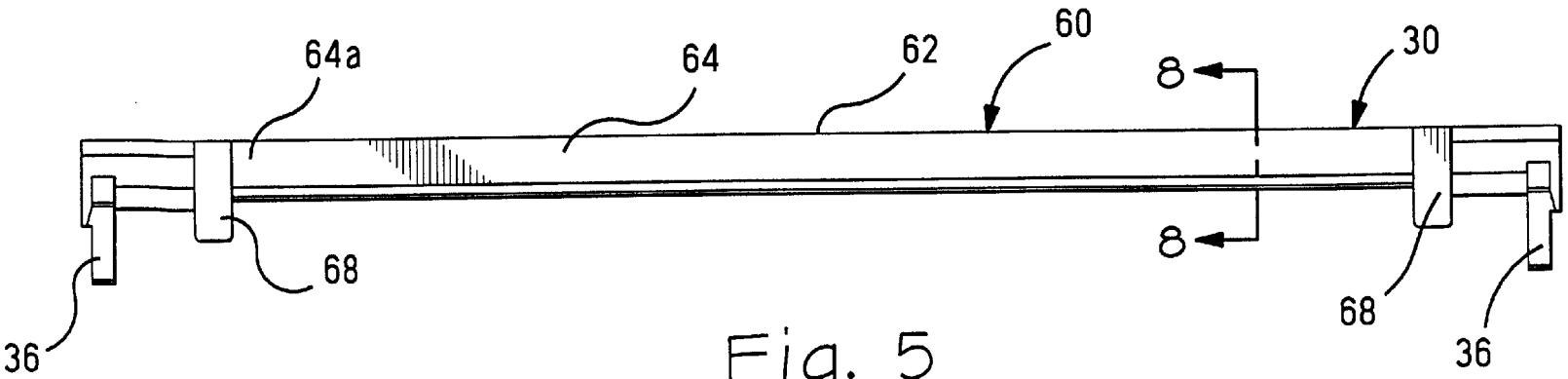
Figure 6:
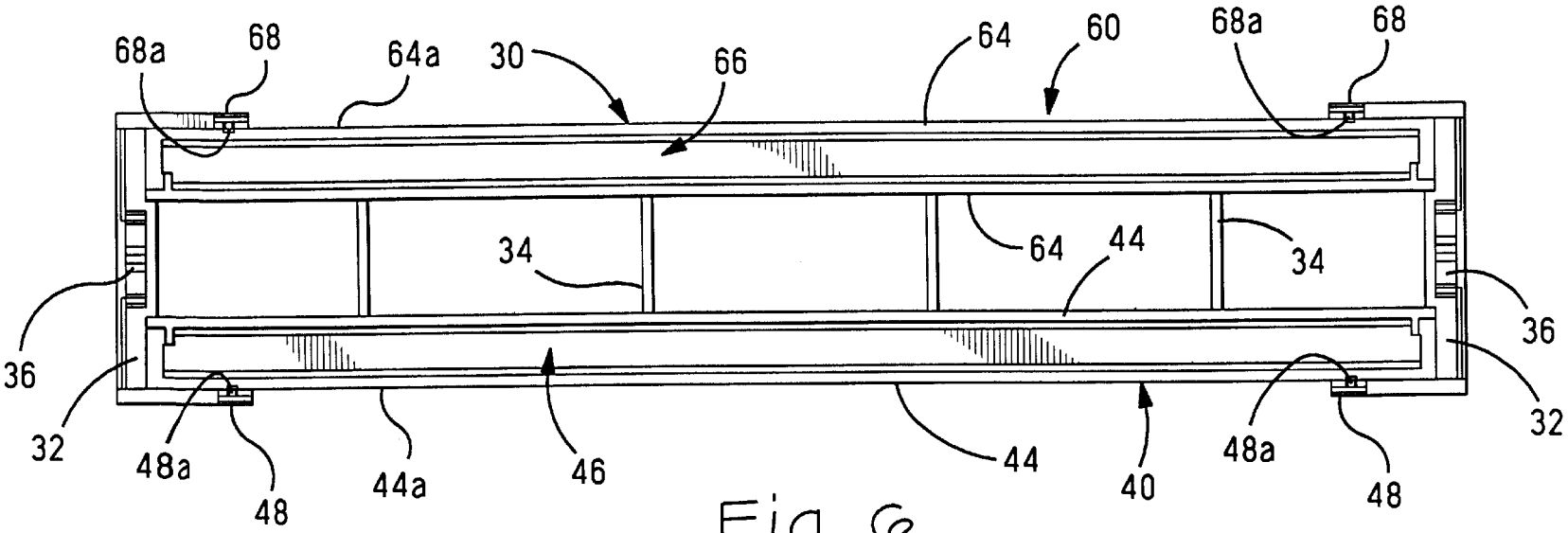
Figure 8:
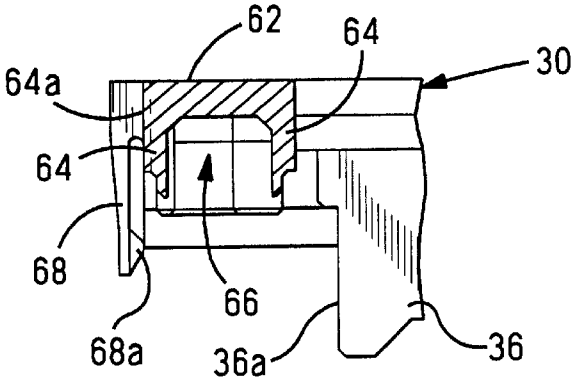
FIG. 8 is a cross-sectional view of the cap housing of FIGS. 4 to 7 taken along line 8—8 of FIG. 5.
Figure 7:
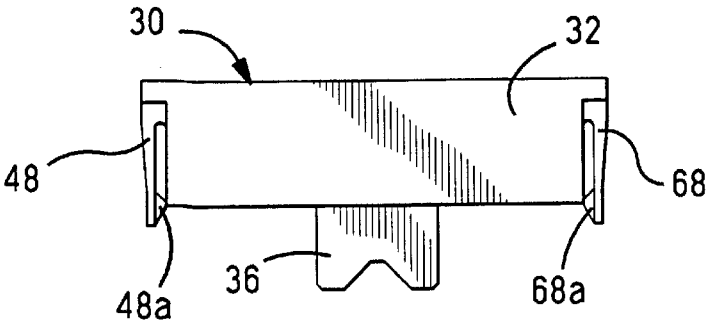
Figure 9:
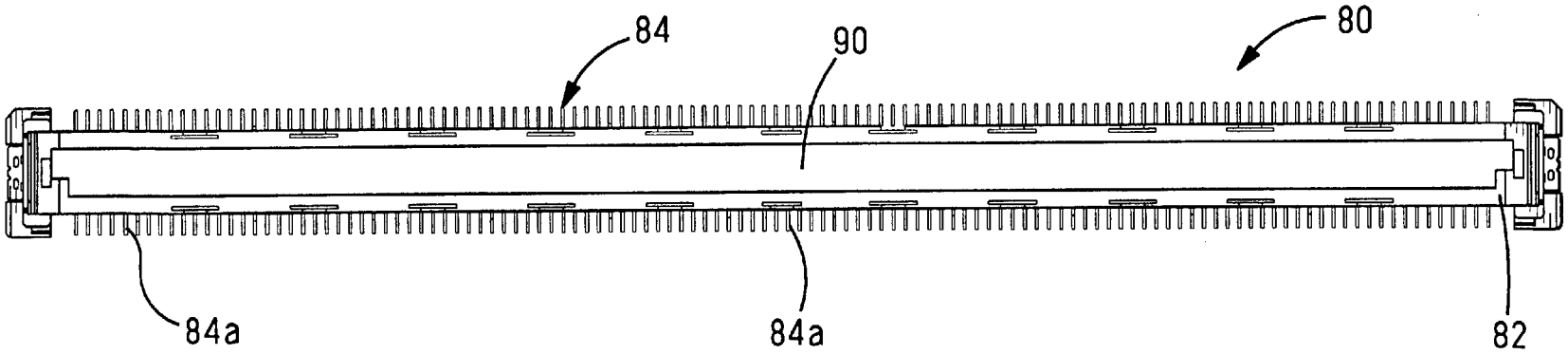
FIGS. 9 and 10 are top plan and side views of an electrical connector for mounting to the cap housing of FIGS. 4 to 8.
Figure 10:
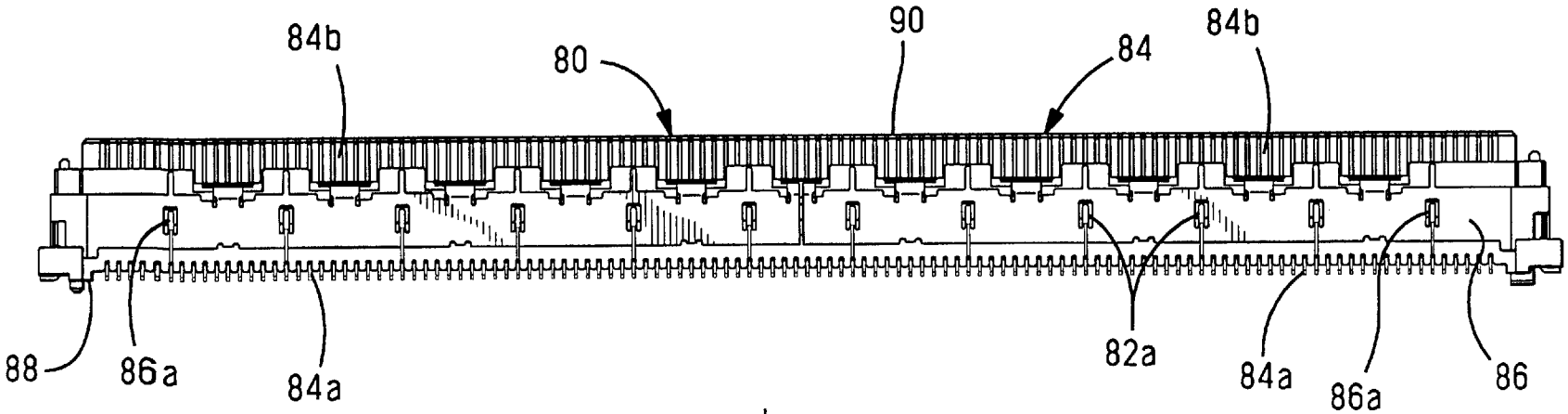

Best seen in FIGS. 4 and 6, each cap portion 40,60 is formed with an upper wall 42,62 and sidewalls 44,64 to define grooves or receiving channels 46,66 which constitute spaces surrounded by these walls in which an electrical connector 80 is received (see FIGS. 9 and 10). Alignment plates 36 (FIGS. 5 through 8) are formed at both ends of the cap portions 40,60 at center portions of the spaced ribs 32 for alignment of the electrical connectors 80 by abutting sidewalls of the housing of electrical connectors 80 (see FIG. 13) against side surfaces 36*a* of the alignment plates 36, thereby preventing any misalignment of the electrical connector 80 when retained in the cap housing 30. At both end portions of outer surfaces 44*a*,64*a* of the sidewalls 44,64 of each cap portion 40, 60 resilient arms 48,68 are located for engagement with the electrical connectors 80 to maintain them on the cap portions. The arms 48,68 are formed with projections 48*a*,68*a* (FIGS. 6 through 8) projecting inwardly from the free ends thereof. The projections 48*a*,68*a* enter openings 86*a* in a ground plate 86 on the housing of the electrical connectors 80 (see FIGS. 12 and 13). Note that holes 49,69 are formed in the upper wall 42,62 of each cap portion 40,60 (FIG. 4) for inserting and extracting core pins (not shown).

FIGS. 9 and 10 show the electrical connector to be secured in the cap housing 30. The electrical connector 80 is provided with a housing 82 and a large number of electrical contacts 84 are disposed in the housing 82. The housing 82 is formed with a plurality of projections 82*a* at the sidewalls designed to enter the openings 86*a* in the ground plate 86 which is secured on the sidewall of the housing 82. As described above, the projections 48*a*,68*a* of the arms 48,68 are designed to enter the two openings 86*a* at both ends among many openings 86*a* in the ground plate 86. Also, the housing 82 has a bottom surface 88 facing a circuit board (not shown) and a top surface 90 at an opposite location to the bottom surface. Each contact 84 has a tine portion 84*a* at each side of the bottom surface 88 to be engaged with a solder pad on a circuit board and a contact portion 84*b* located along each side of the housing 82 defining a mating section for engagement with a mating contact (not shown).

Figure 11:
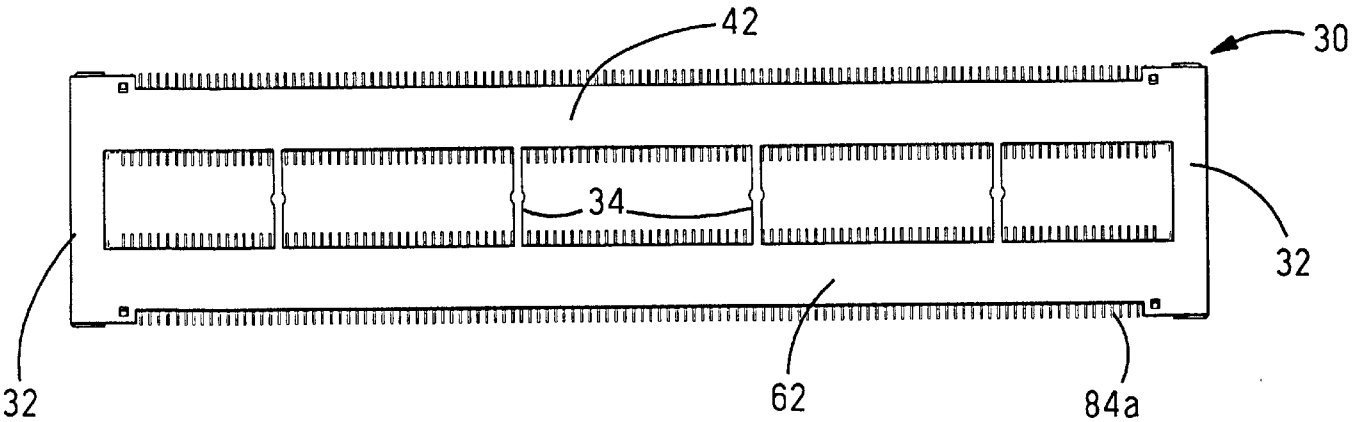
FIG. 11 is a top plan view of the cap housing of FIG. 4 having the electrical connector of FIGS. 9 and 10 mounted thereto.
Figure 12:
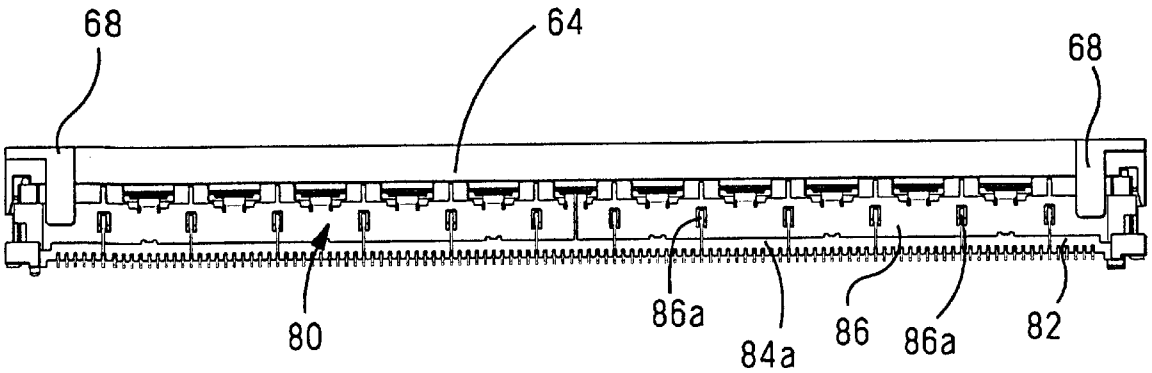
FIGS. 12 and 13 are side and end views, respectively, of FIG. 11.
Figure 13:
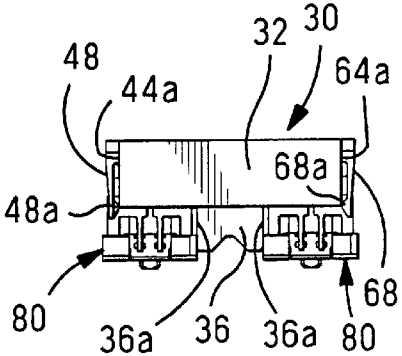
Figure 14:
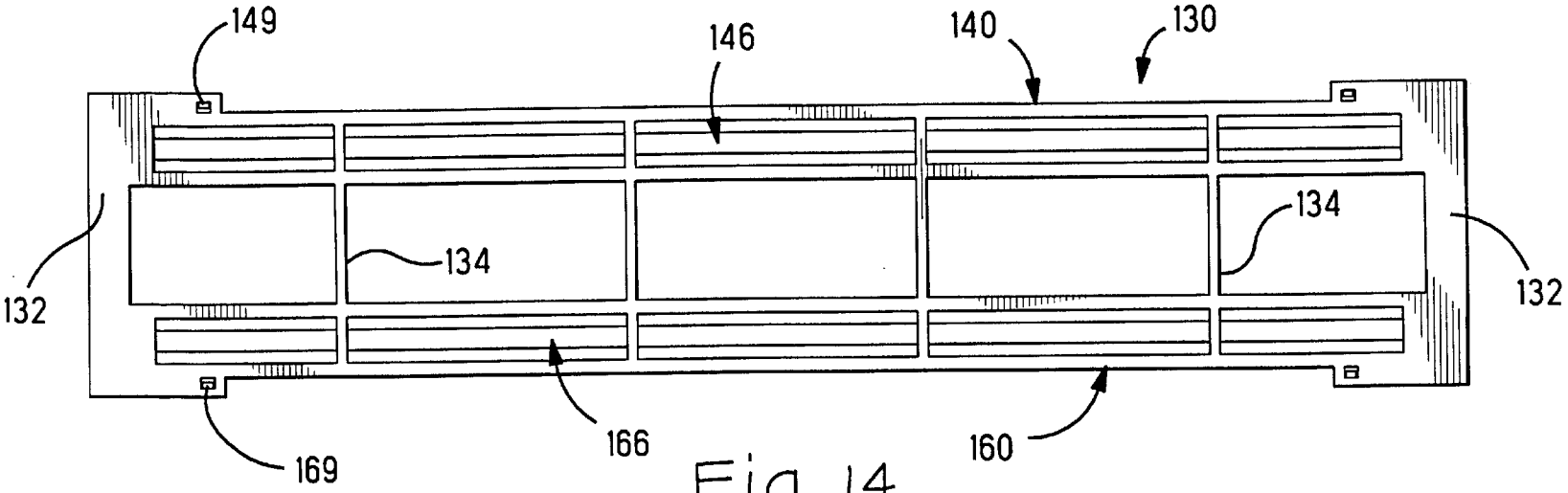
FIG. 14 is a top plan view of a second embodiment of the cap housing of the present invention.
Figure 15:
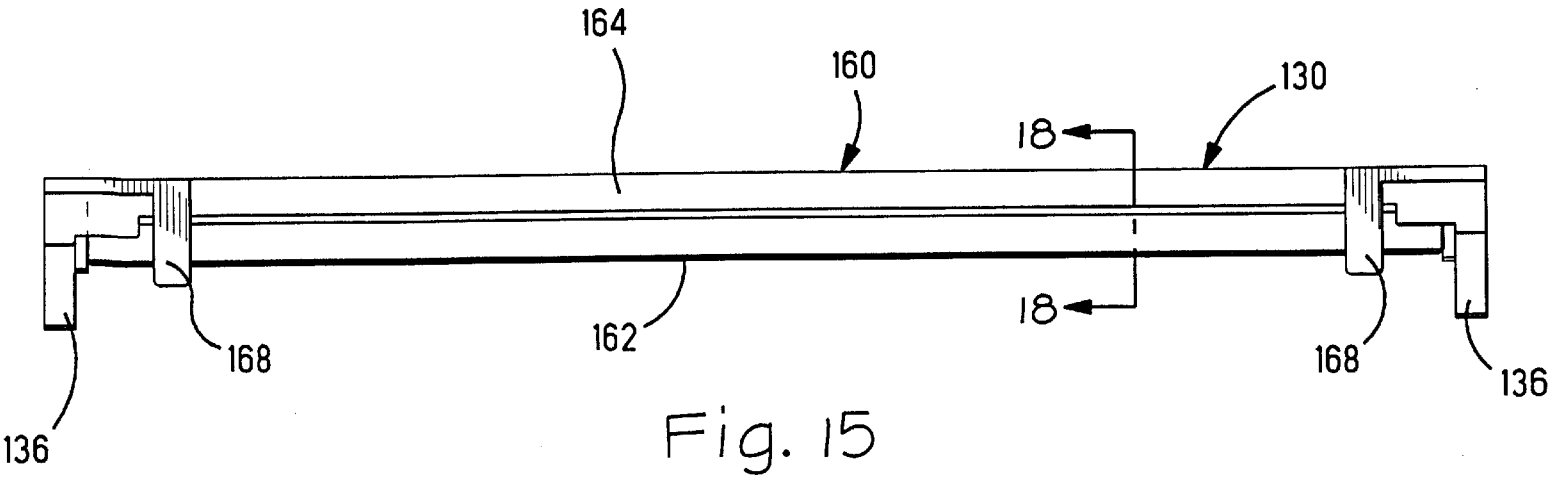
FIGS. 15 to 17 are side, bottom and end views of the cap housing of FIG. 14.

FIGS. 11 through 13 show electrical connectors 80 retained in the cap housing 30. As described above, electrical connectors 80 are received in the grooves 46,66 (see FIG. 6) in the cap housing 30 which are firmly and removably retained in the cap housing 30 by the projections 48*a*,68*a* of the arms 48,68 engagingly entering the openings 86*a* in the ground plate 86. In the manner, the cap housing 30 not only secures the housings 82 of the electrical connectors 80 therein but also covers and protects the top surface 90 of the housing 82 and the contact portions 84*b* of the contacts 84. As a result, the contact portions 84*b* are kept clean from flux and the like which may otherwise attach thereto when the tine portions 84*a* are soldered to a circuit board, thereby establishing excellent electrical engagement with matable contacts. Also, the contact portions 84*b* are kept clean and protected during transportation of the electrical connectors 80. Additionally, two electrical connectors 80 can be mounted on a circuit board or transported simultaneously by holding them in the two cap portions 40,60 of the cap housing 30. It is to be noted that the particular cap housing 30 described above has two parallel cap portions 40,60 but may have more than two cap portions. Also, the two cap portions 40,60 may be disposed in a V-shape or three cap portions may be disposed in a U-shape depending on particular arrangements of the electrical connectors to be mounted on a circuit board.

Reference will now be made to FIGS. 14 through 23 to describe a second embodiment of the cap housing for electrical connectors according to the present invention.

FIGS. 14 through 18 show the cap housing 130 which is formed with two parallel cap portions 140,160 integrally formed by being coupled at both ends by spaced ribs 132. The cap portions 140,160 are further coupled together by spaced ribs 134 for preventing the cap housing 130 from warping.

Figure 18:
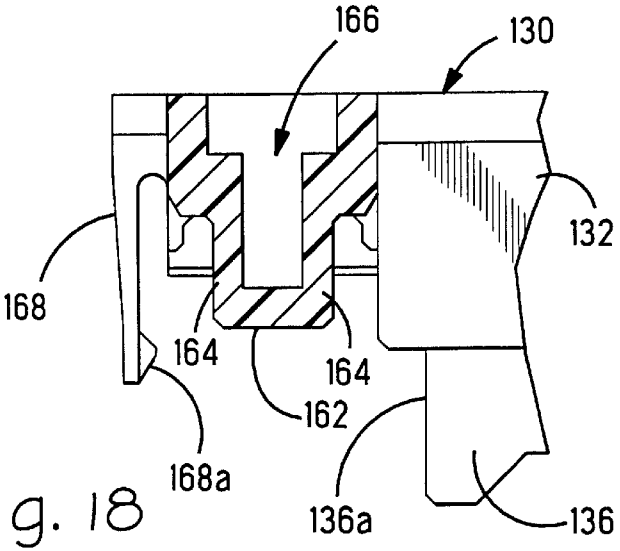
FIG. 18 is a cross-sectional view of the cap housing of FIGS. 14 to 17 taken along line 18—18 of FIG. 15.
Figure 17:
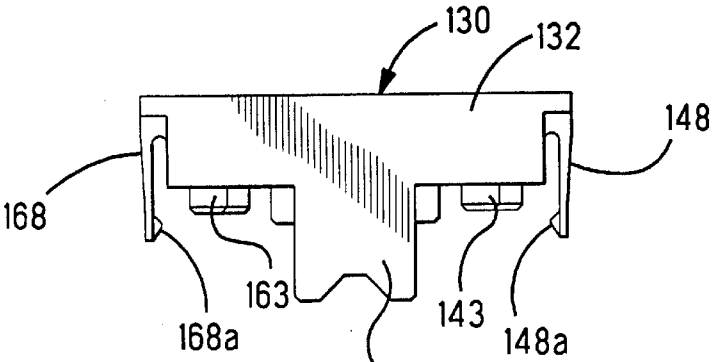
Figure 21:
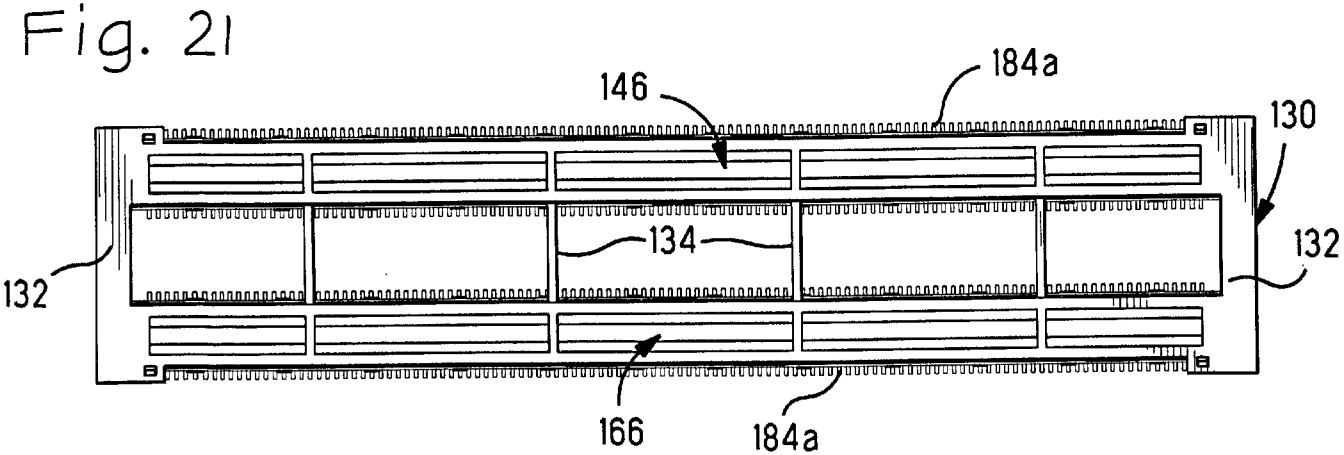
FIG. 21 is a top plan view of the cap housing of FIG. 14 having the electrical connectors of FIG. 19 and 20 mounted thereto.

Each cap portion 140,160 comprises a protrusion or projecting portion 143,163 including a bottom wall 142,162, and sidewalls 144,164 to define spaces or recesses 146,166 (FIGS. 17, 18 and 21). There are formed alignment plates 136 at center portions of the spaced ribs 132. Sidewalls of the housings of the electrical connectors 180 (see FIG. 23) abut against the side surfaces 136*a* of the alignment plates 136, thereby preventing misalignment of the electrical connectors 180 mounted onto the cap housing 130. Resilient arms 148,168 are formed at both ends of the external side surfaces 144*a*, 164*a* of the sidewalls 144, 146 for engaging against a ground plate 186 (see FIG. 23). The arms 148,168 are formed with projections 148*a*,168*a* at the ends thereof extending inwardly for engaging the ground plate 186, thereby removably retaining the cap housing 130 onto the housing of the electrical connector 180 by the projections. Note that the ground plate 186 is formed with holes 182*a* to receive the projections 148*a*,168*a* therein for holding the housing of the electrical connector 180 onto the cap housing. Note that there are formed openings 149,169 (FIG. 14) in the sidewalls 144,166 of each cap portion 140,160 for insertion and removal of a core pins (not shown).

Figure 16:
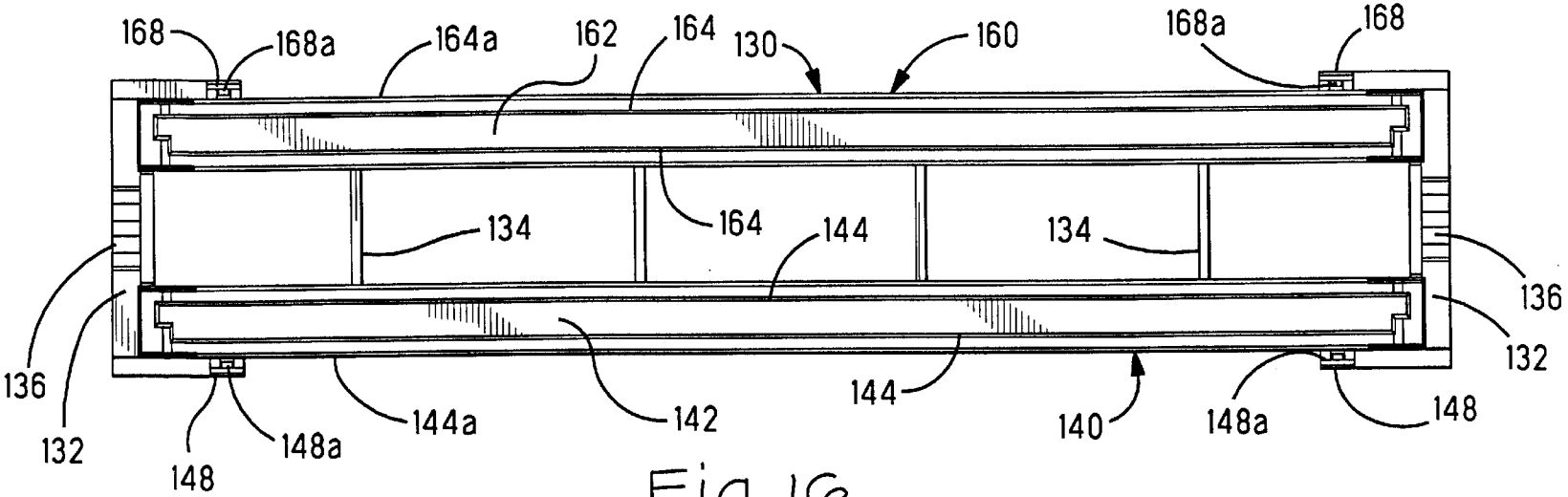
Figure 19:
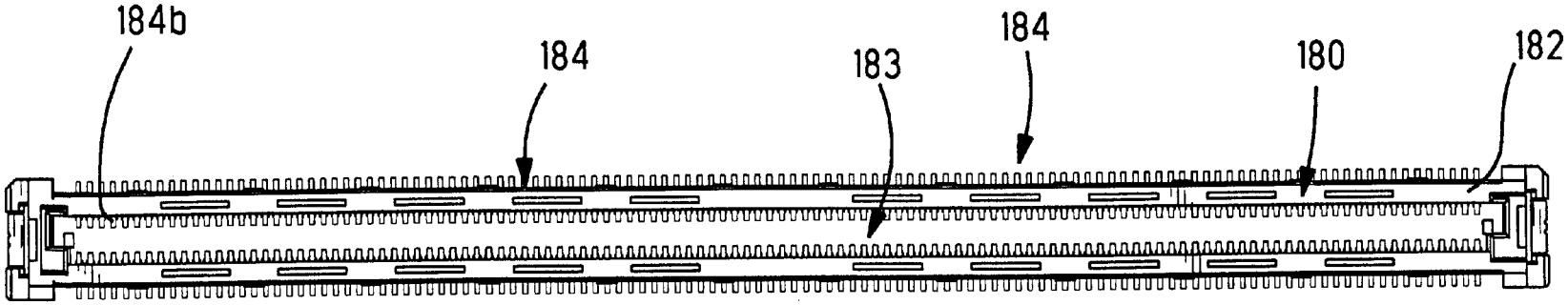
FIG. 19 is a top plan view of an electrical connector for mounting to the cap housing of FIG. 14.
Figure 20:
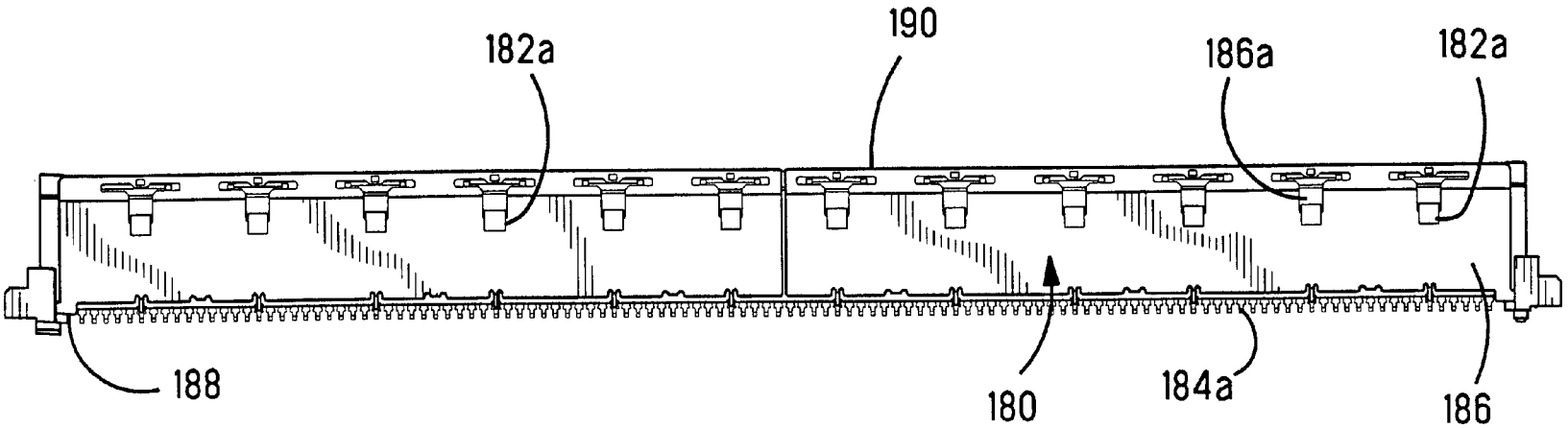
FIG. 20 is a side view of FIG. 19.

FIGS. 19 and 20 show electrical connector 180 to be mounted onto the cap housing 130 as shown in FIG. 16. The electrical connector 180 includes a housing 182 and a large number of electrical contacts 184 disposed in the housing 182. A groove 183 is formed at the center portion of the housing 182 in the longitudinal direction for matingly receiving protrusions 143,163 of the cap housing 130. There are a plurality of projections 182*a* on the sidewall of the housing 182 to be engagingly received in openings 186*a* in the ground plates 186 which is secured on the sidewall of the housing 182. The housing 182 has a bottom surface 188 facing a circuit board (not shown) and a top surface 190 at an opposite location to the bottom surface 188. Each contact 184 has a tine portion 184*a* located at the bottom surface 188 to be engaged with a solder pad on circuit board and a contact portion 184*b* along a surface of groove 183 for engagement with a matable contact (not shown).

Figure 22:
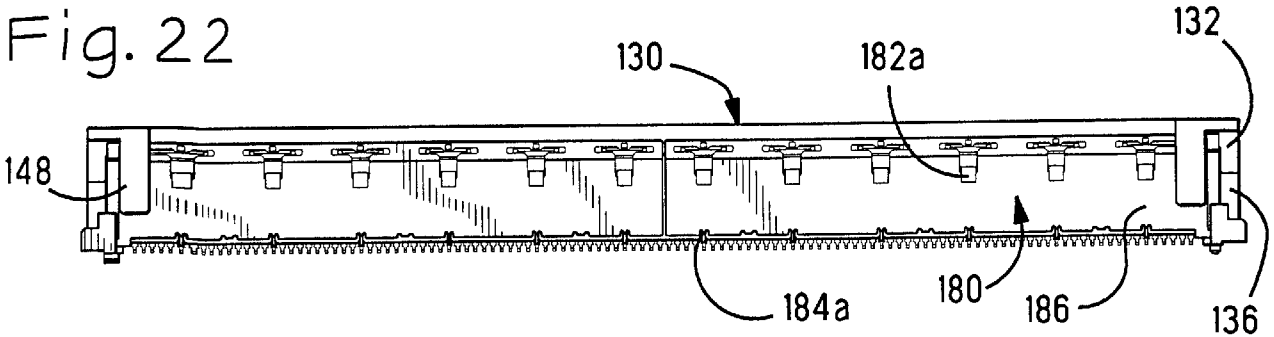
FIGS. 22 and 23 are side and end views, respectively, of the assembly of FIG. 21.
Figure 23:
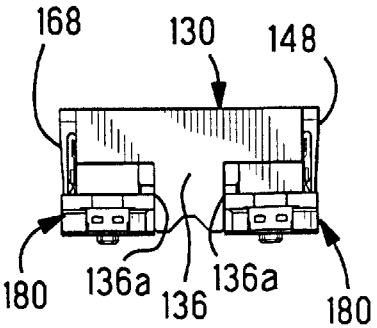
Figure 24:
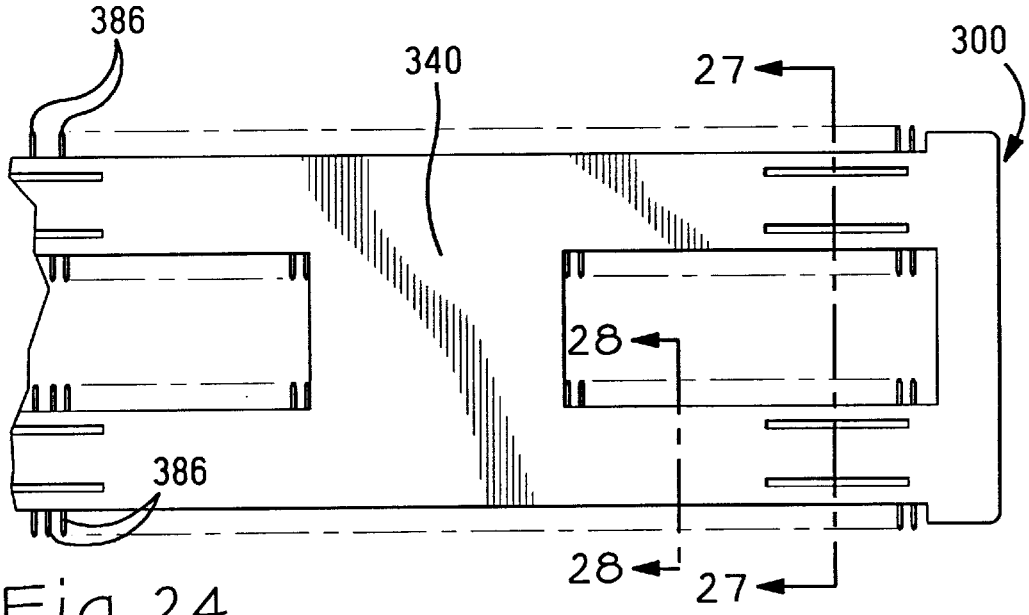
FIG. 24 is a part top plan view of a third embodiment of the cap housing of the present invention mounted to a male electrical connector.
Figure 25:
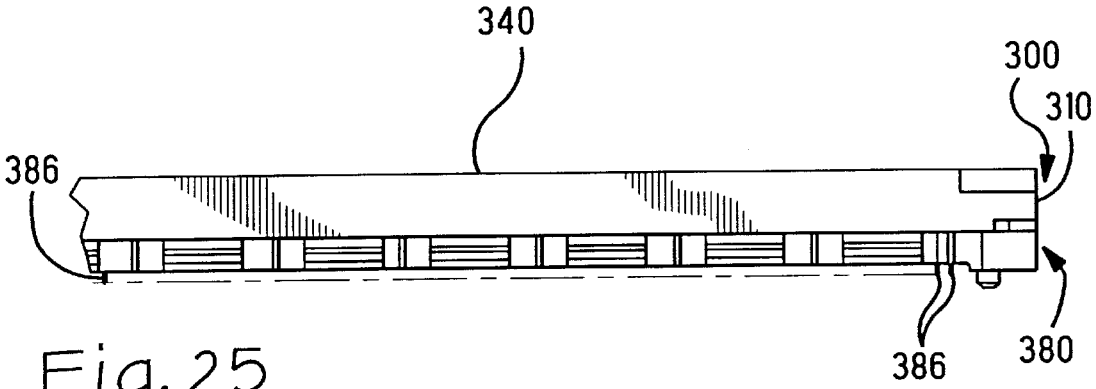
FIGS. 25 and 26 are side and end views, respectively, of the assembly of FIG. 24.
Figure 26:
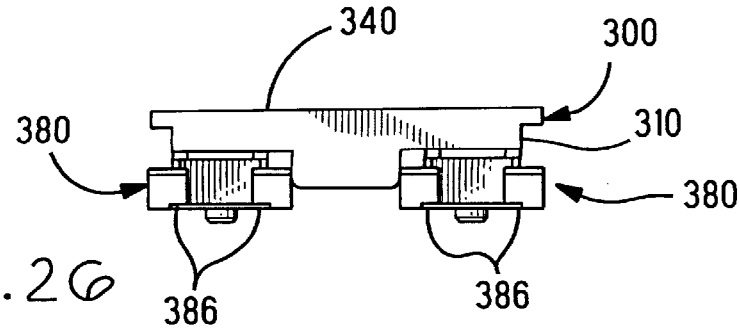
Figure 27:
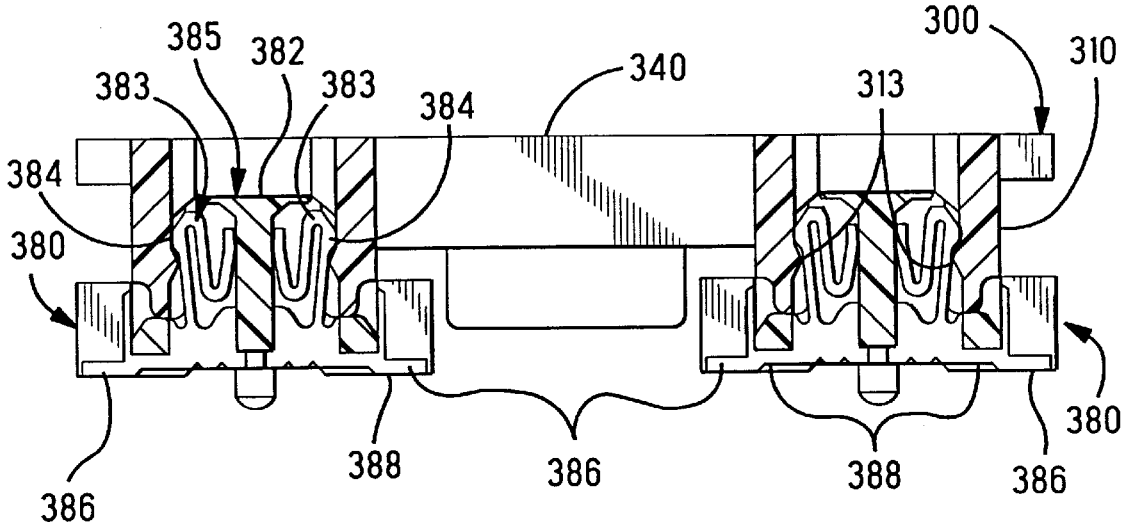
FIG. 27 is a cross-sectional view of the assembly of FIG. 24 taken along line 27—27 thereof.

FIGS. 21 through 23 show the electrical connector 180 secured to the cap housing 130. As described hereinbefore, the protrusions 143,163 of the cap housing 130 are snapped in the grooves 183 of the electrical connectors 180 while the arms 148,168 engage the ground plate 186 with projections 148*a*,168*a* being disposed in holes 182*a* of ground plate 186, thereby removably mounting the cap housing 130 onto the housings 182 of the electrical connectors 180. This particular way of securing the cap housing 130 onto the housings 182 of the electrical connectors 180 covers for protection purposes the top surfaces 190 of the housings 182 and the contact portions 184*b* of the contacts 184. As a result, flux or any foreign material is kept away from the contact portions 184*b* during a soldering operation of the tine portions 184*a* to a circuit board, thereby assuring excellent electrical contact with matable contacts. Also, the contact portions 184*b* are dust free during transportation of the electrical connectors 180. Moreover, a pair of the electrical connectors 180 are simultaneously held in the two cap portions 140,160 in the cap housing 130 for convenience of mounting on a circuit board or transportation. The two parallel cap portions 140, 160 are formed in the particular cap housing 130 just described herein. However, it is to be noted that more than two cap portions may be provided and two cap portions 140,160 may be disposed in a V-shape or three cap portions may be disposed integrally in a U-shape depending on the particular arrangement of such electrical connectors on a circuit board.

Now reference is made to FIGS. 24 through 28 to describe a third embodiment of the cap housing according to the present invention.

In this particular embodiment, the cap housing according to the present invention is designed for mounting to a male type electrical connector.

Figure 28:
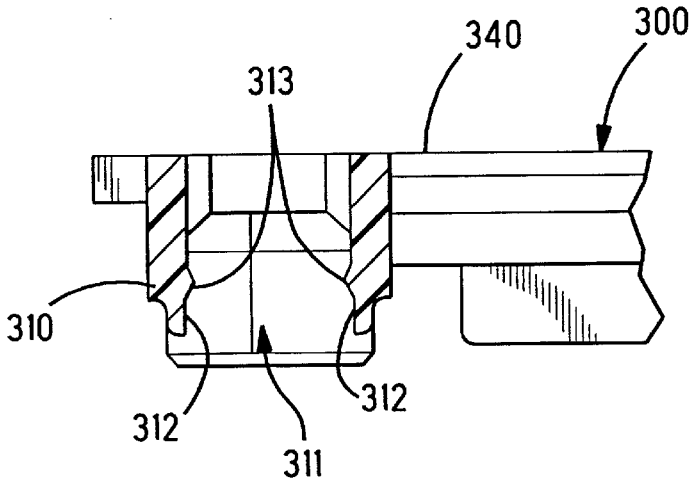
FIG. 28 is a cross-sectional view of the cap housing of FIG. 24 taken along line 28—28 thereof.
Figure 29:
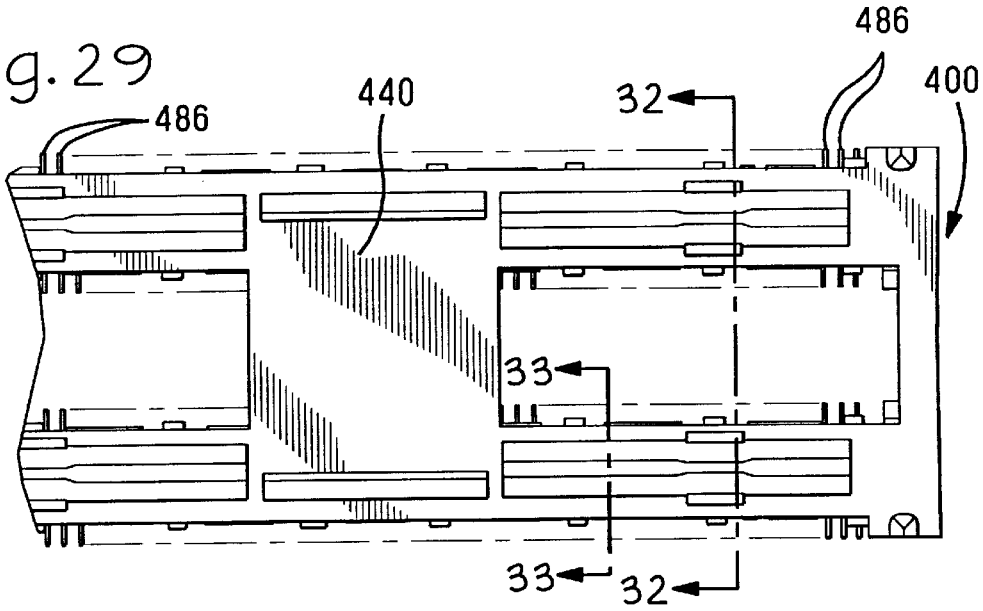
FIG. 29 is a top plan view of a fourth embodiment of the cap housing of the invention mounted to a female electrical connector.
Figure 30:
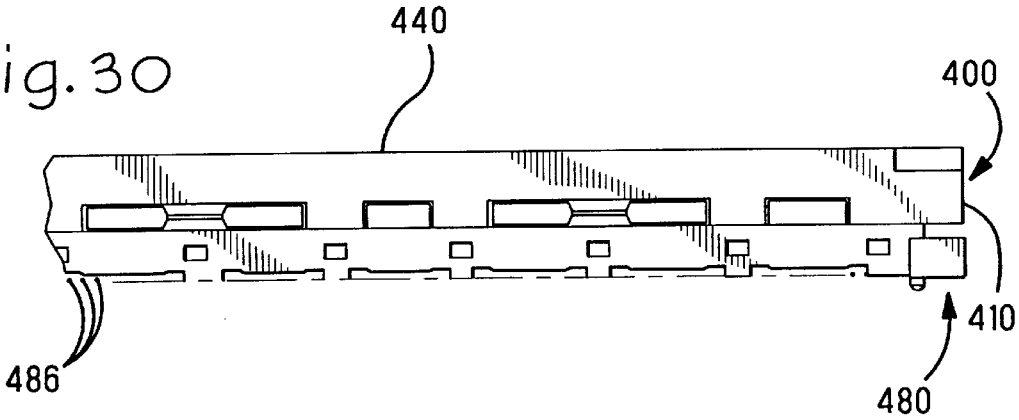
FIGS. 30 and 31 are side and end views, respectively, of the assembly of FIG. 29.
Figure 31:
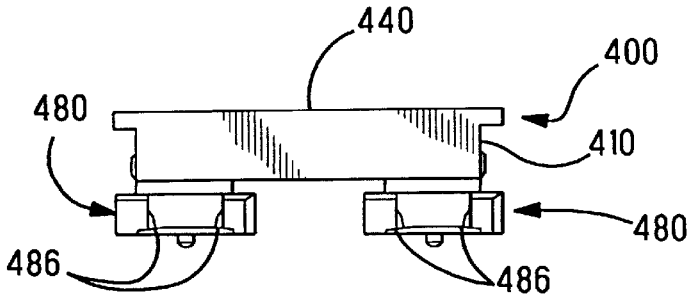
Figure 32:
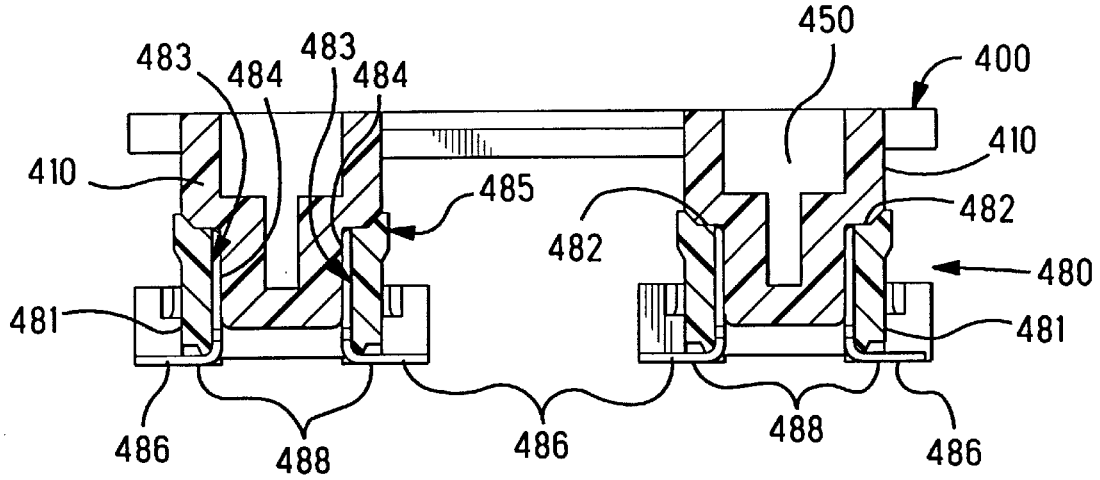
FIG. 32 is a cross-sectional view of the assembly of FIG. 29 taken along line 32—32 thereof.

As apparent from FIGS. 24 through 27, a cap portion 310 of the cap housing 300 is adapted to be mounted on a male type electrical connector 380 to cover a mating portion 385 near the top surface 382 thereof. Electrical contacts 383 are secured in the mating portion 385 of the male type electrical connector 380 with contact portions 384 of the contacts 383 adapted to make electrical contact with contact portions of respective contacts in a matable connector (not shown) when the mating portion 385 of the male type electrical connector 380 is mated with a complementary mating portion of the matable connector. As best shown in FIG. 28, the cap portion 310 of the cap housing 300 is formed with a recess 311 having sidewalls 312 formed with engaging projections 313. The engaging projections 313 are adapted to engage the contacts 383 of the male type electrical connector 380 when it is mounted on the cap housing 300. In this particular embodiment, the engaging projections 313 are not externally located because the male type electrical connector 380 engages inside the cap portion 310 in the cap housing 300. Also, they are not easily disengaged once the cap housing 300 is mounted on the male type electrical connector. Additionally, provision of the engaging projections 313 inside the cap portion 310 contributes to minimize the size of the cap housing as compared to the case where the engaging members such as resilient latch members 48,68 with an electrical connector are provided on the outer surfaces 44*a*,64*a* of the sidewalls 44,64 of the cap portions 40,60 as shown in FIGS. 4 through 8.

When the cap housing 300 is mounted on the electrical connector 380 as mentioned above, tine portions 386 at the bottom surface 388 opposite to the top surface 382 of the male type electrical connector 380 are soldered to a circuit board (not shown) for mounting the electrical connector 380 at a predetermined location on the circuit board.

In the particular embodiment, engagement of the engaging projections 313 in the cap housing 300 with a plurality of electrical contacts 383 disposed in the male type electrical connector 380 eliminates strict requirements for proper alignment between the male type electrical connector 380 and the cap housing 300, thereby improving the operational characteristics of placing the connectors onto a circuit board and protecting the contact portions 384 in the same manner as in the other embodiments.

Furthermore, the cap housing 300 in this particular embodiment is formed with at least one transverse wall (FIG. 24) spaced from an end of the cap and having a planar top surface sufficiently wide to define a vacuum pick-up surface 340 at the top thereof for convenience of transportation and alignment of the cap housing 300 by a conventional automatic machine having a vacuum pick-up nozzle.

Reference is now made to FIGS. 29 through 34 to describe a fourth embodiment of the cap housing according to the present invention.

Figure 33:
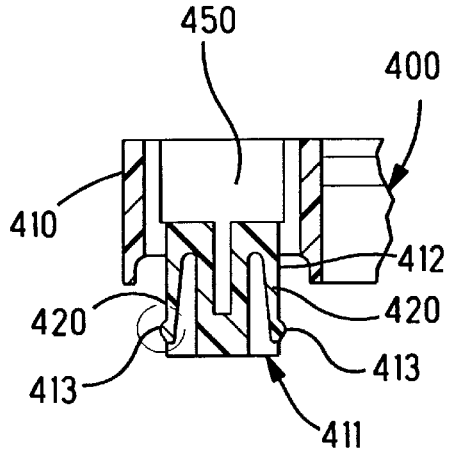
FIG. 33 is a cross-sectional view of the cap housing of FIG. 29 taken along line 33—33 thereof.
Figure 34:
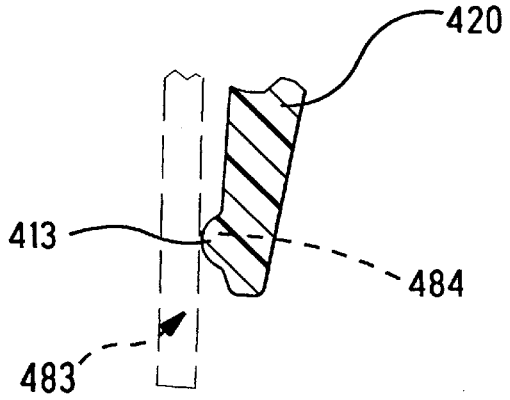
FIG. 34 is a part magnified view of the cap housing of FIG. 33 in engagement with a contact of the connector of FIG. 29.

As shown in FIGS. 29 through 32, a cap portion 410 of the cap housing 400 is adapted to be mounted on a female type electrical connector 480 to cover its mating portion 485 near the top surface 482 thereof. Disposed in the mating portion 485 of the female type electrical connector 480 are electrical contacts 483 having contact portions 484 adapted to electrically engage respective contacts in a matable connector (not shown) when the matable portion 485 of the female type electrical connector 480 is mated with a complementary mating portion of the matable connector. As best shown in FIGS. 33 and 34, the cap portion 410 of the cap housing 400 is formed with a projection 411 to be received in the female type electrical connector 480. Formed at the tips of the sidewalls 412 of the protrusion 411 are resilient arms or engaging members 420 to engage the contacts 483 of the female type electrical connector 480. Also, formed near the tips of the resilient engaging members 420 are engaging projections 413 which engage the contacts 483 at points 484 of the female type electrical connector 480 when the cap housing 400 is mounted on the female type electrical connector 480. In this particular embodiment, the cap housing 400 and the female type electrical connector 480 are engaged inside the cap portion 410 of the cap housing 400, the engaging projections 413 have no external interference, thereby assuring that the cap housing is not easily removed from the female type electrical connector once mounted thereto. Additionally, since the engaging projections are formed inside the cap portion 410, the entire cap housing can be made compact because of the same reason as the cap housing 300 and the male type electrical connector described above.

The cap housing 400 is mounted on the female type electrical connector 480 in the above manner and the tine portions 486 at the bottom surface 488 opposite to the top surface 482 of the female type electrical connector 480 are soldered onto a circuit board (not shown) for mounting the female type electrical connector 480 at a predetermined location on the circuit board.

Also, in this particular embodiment, the engaging projections 413 formed on the cap housing 400 engage a large number of electrical contacts 483 disposed in rows in the female type electrical connector 480, thereby eliminating strict accuracy requirements for alignment when engaging the female type electrical connector 480. This improves the operational characteristics as pointed out above in regard to cap housing 300.

It is also noted that the cap housing 400 in this particular embodiment features the use of vacuum pick-up surface 440 on the top surface. A vacuum nozzle of an automatic vacuum pick-up machine may be attached to the vacuum pick-up surface 440 for precisely placing of the cap housing 400 onto a circuit board and to protect the contact portions during shipment of the connectors mounted onto the cap housing.

Additionally, the cap housing 400 has openings 450 at upper portions thereof for preventing the cap housing 400 from warping or deforming due to internal stress during the molding process of the cap housing.

Referring now to FIGS. 35 through 39, a fifth embodiment of the cap housing according to the present invention will be described.

As apparent from FIGS. 35 through 39, the fifth embodiment of the cap housing 500 according to the present invention is formed with a first cap portion 511 at one surface 501 and a second cap portion 512 at the opposite surface 502. The first cap portion 511 is adapted via a groove 515 to cover a male type mating portion 585 containing contact portions 584 of the electrical contacts 583 to the top surface 582 of the male type electrical connector 580 while the second cap portion 512 is adapted to cover a female type mounting portion 685 containing contact portions 684 of the electrical contacts 683 to the top surface 682 of the female type electrical connector 680.

Note that the mating portion 585 of the male type electrical connector 580 and the mating portion 685 of the female type electrical connector 680 are designed to mate with each other.

Figure 35:
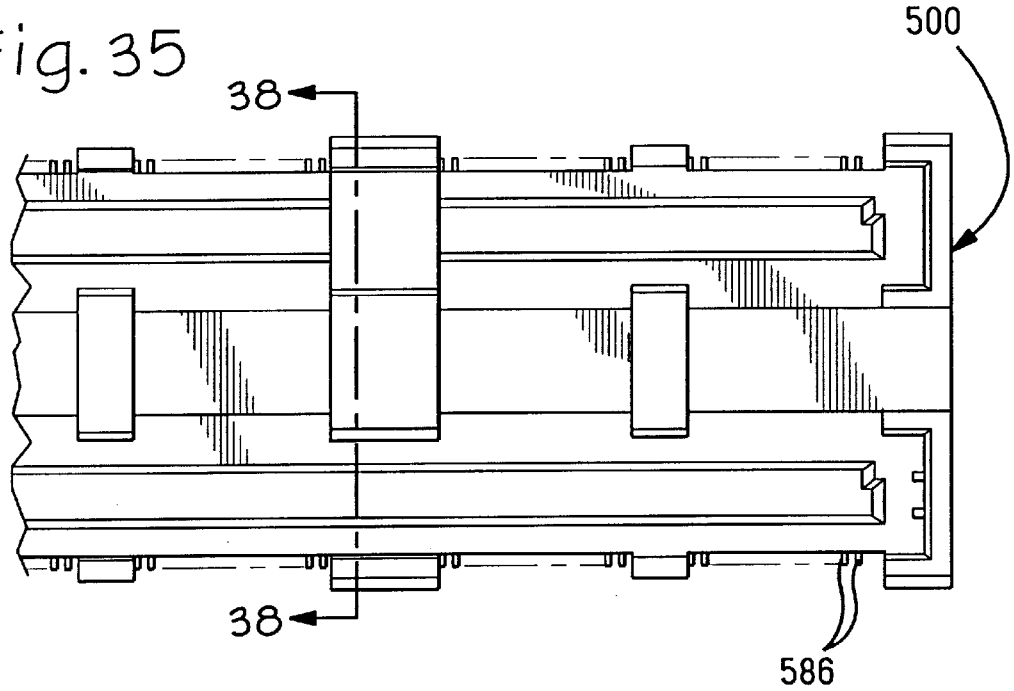
FIG. 35 is a top plan view of a fifth embodiment of the cap housing of the invention mounted to a male electrical connector.
Figure 36:
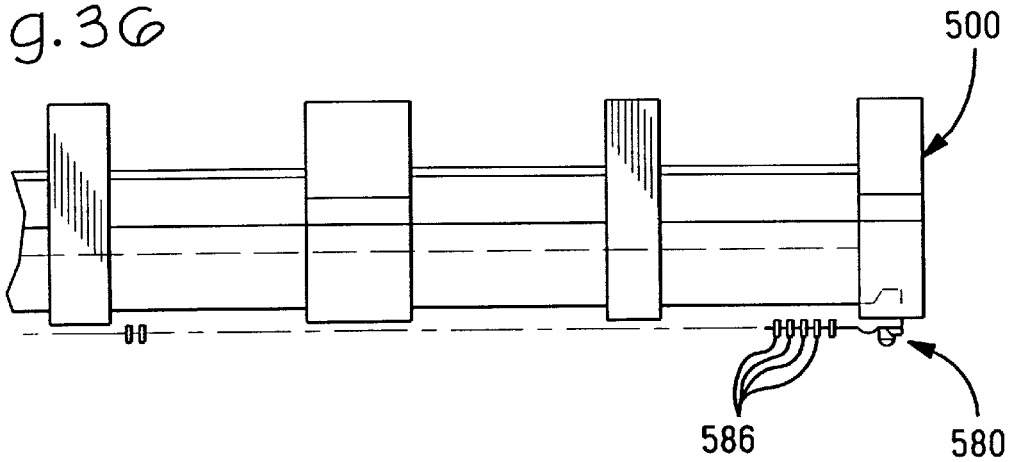
FIGS. 36 and 37 are side and end views, respectively, of the cap housing of FIG. 35.
Figure 37:
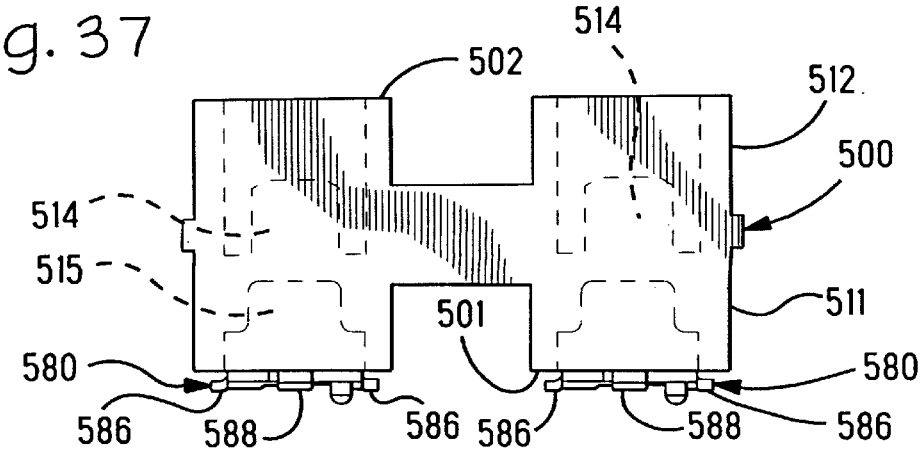
Figure 38:
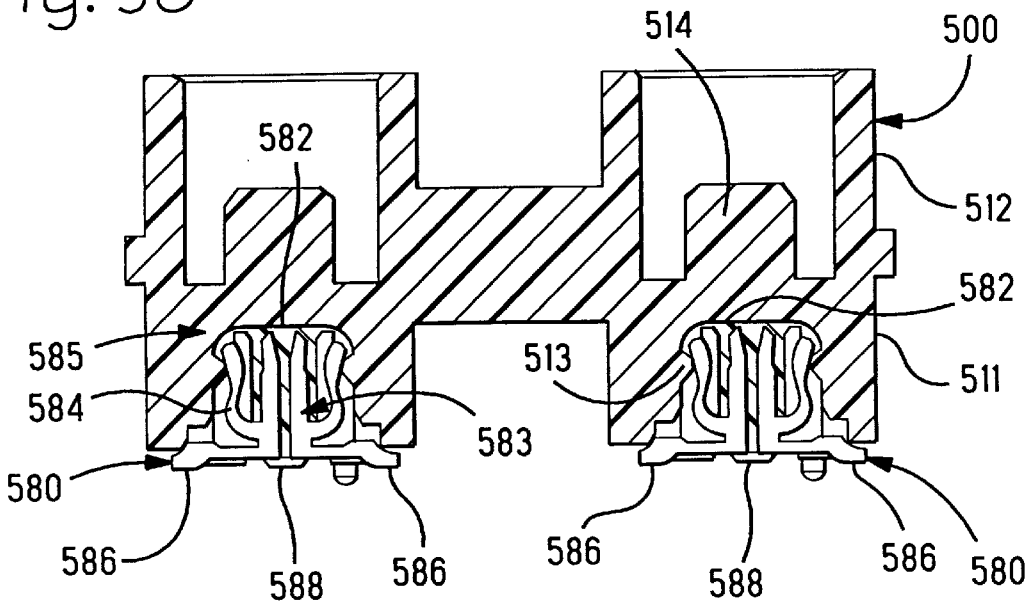
FIG. 38 is a cross-sectional view of the assembly of FIG. 35 taken along line 38—38 thereof.
Figure 39:
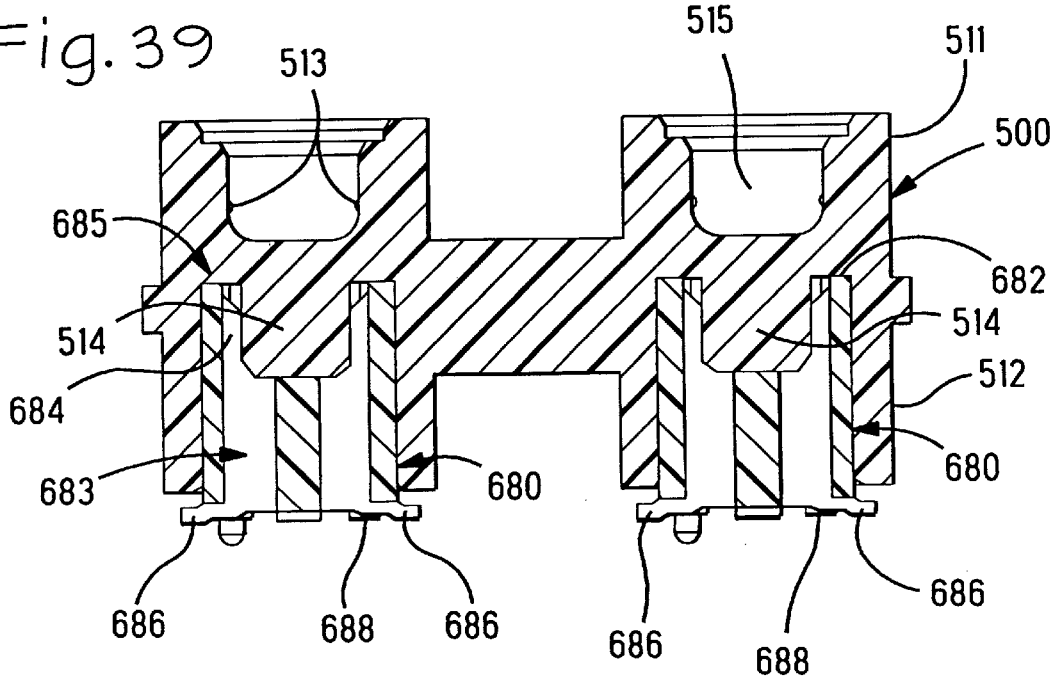
FIG. 39 is a view similar to FIG. 38 of the cap housing of FIG. 35 mounted to a female electrical connector.

As best shown in FIGS. 35 and 38, when the cap housing 500 is mounted on the male type electrical connector 580, the tine portions 586 formed at the bottom surface 588 of the male type electrical connector 580 may be soldered onto a circuit board (not shown) for mounting the male type electrical connector 580 at a predetermined location on the circuit board.

Electrical connector 580 is held onto cap portion 511 via projections 513 which engage contact portions 584; whereas electrical connector 680 is held onto cap portion 512 via the frictional engagement of contact portions 684 with the walls of protrusion 514 of cap portion 512.

The above particular configuration of the fifth embodiment of the cap housing 500 provides both functions as the cap housing for both male type and female type electrical connectors using a single cap housing. Also, the production cost can be reduced because a single cap housing can be used easily as a cap housing for both male type and female type electrical connectors.

As understood from the above description, the first and second embodiments of the cap housing for electrical connectors according to the present invention features a plurality of integrally formed cap portions for covering a top surface of a connector housing as well as a mating portion containing contact portions of electrical contacts. This arrangement helps to protect the top surface of the housing and the mating portion and contact portions of the contacts covered by the cap housing during mounting on a circuit board or transportation of the electrical connectors, thereby protecting the contact portions of the contacts from collecting flux, dust, etc. Additionally, since a plurality of cap portions of the first embodiment of the cap housing is integrally formed, a plurality of electrical connectors can be simultaneously mounted on a circuit board or transported. Such plurality of electrical connectors are properly aligned with each other.

Additionally, in the third embodiment of the cap housing according to the present invention, the cap portion in the cap housing is formed with engaging projections which has no substantial external interference, thereby making it difficult to be disengaged from the electrical connector. Also, such particular configuration having the engaging portions inside the cap housing helps reduce the size of the cap housing as a whole.

Furthermore, in the fourth and fifth embodiments of the cap housing according to the present invention, a first cap portion for a male type electrical connector is formed in one surface, while a second cap portion for a female type electrical connector is formed in the opposite surface. As a result, the cap housing can be used commonly for both male type and female type electrical connectors, which has various manufacturing advantages and helps to reduce production cost.

What is claimed is:

1. A cap housing to which electrical connectors can be mounted for positioning tine portions of electrical contacts secured in dielectric housings onto solder pads of circuit boards so that the tine positions can be soldered to the circuits comprising cap portions in which mating sections of the dielectric housings containing contact portions of the electrical contacts can be received, characterized in that:

alignment plates are located between the cap portions against which sides of the electrical connectors engage, and resilient arms are provided by the cap portions and include projections that can be disposed in holes of the electrical connectors thereby maintaining the electrical connectors in position on the cap portions against the alignment plates.

2. A cap housing as claimed in claim 1, wherein spaced ribs extend between the cap portion.

3. A cap housing as claimed in claim 2, wherein the holes are located in a ground plate on a side of the connector housings.

4. A cap housing as claimed in claim 1, wherein the holes are located in a ground plate on a side of the connector housings.

5. A cap housing as claimed in claim 1, wherein the cap portions include grooves in which the mating sections of the dielectric housings containing contact portions can be received.

6. A cap housing as claimed in claim 5, wherein spaced ribs extend between the cap portion.

7. A cap housing as claimed in claim 5, wherein the holes are located in a ground plate on a side of the connector housings.

8. A cap housing as claimed in claim 1, wherein the cap portions include protrusions onto which the mating sections of the dielectric housings containing contact portions can be engaged.

9. A cap housing as claimed in claim 8, wherein spaced ribs extend between the cap portion.

10. A cap housing as claimed in claim 8, wherein the holes are located in a ground plate on a side of the connector housings.

11. A cap housing as claimed in claim 1, wherein the holes are located in a ground plate on a side of the connector housings.

12. An electrical connector cap to be removably attached onto a mating portion of a board mountable elongated electrical connector, substantially covering said mating portion in the substantially perpendicular direction with respect to a circuit board, characterized in that:

said cap comprises at least a pair of cap portions to be engaged respectively with said mating connector portion and a mating portion of at least a second connector for mounting said connector and said second connector onto said circuit board in parallel relationship, said pair of cap portions being coupled by at least one transverse wall spaced from an end of said cap and having a planar top surface sufficiently wide to define a vacuum pick-up surface thereon, all forming an integral member.

13. An electrical connector cap as set forth in claim 12 wherein each of said mating portions of said connector and said second connector includes a mating channel determined by a pair of opposed side walls having a plurality of male type contact portions of a plurality of contacts disposed along inner surfaces of said opposed wide walls, said cap comprising:

at least one projection associated with said mating channel and complementary in shape and size to said mating channel to be received thereinto, said projection including latch arms formed along outer side surfaces of said projection to be engaged with said male type contact portions.

14. An electrical connector cap as set forth in claim 12 wherein each of said mating portions of said connector and said second connector including a mating channel determined by a pair of opposed side walls having a plurality of male type contact portions of a plurality of contacts disposed along inner surfaces of said opposed side walls, said cap comprising:

at least a pair of opposed latch arms to be engaged with said male type contacts in said mating channel, said pair of latch arms being disposed to have a configuration and width complementary to said mating channel.

15. An electrical connector cap as set forth in claim 12 wherein each of said mating portions of said connector and said second connector including a projecting portion where a plurality of female type contact portions of said contacts are oppositely disposed along said mating portion along both side surfaces of said projecting portion, said cap comprising:

each of said pair of cap portions having a top wall and opposed side walls to determine a receiving channel to receive said projecting portion, said top wall having at least one pair of holes so that portions of said side walls proximate to said holes have sufficient resiliency and said portions of said opposed side walls having inwardly projecting engaging projections formed on inner surfaces thereof.

16. An electrical connector cap to be removably attached onto a mating portion of a board mountable elongated electrical connector, substantially covering said mating portion in the substantially perpendicular direction with respect to a circuit board, characterized in that:

said cap comprises a pair of cap portions to be engaged respectively with said mating portion of said electrical connector and a mating portion of a second connector, for mounting said electrical connectors onto said circuit board in a parallel relationship, said pair of cap portions being coupled together by walls at both ends and at least one other portion between said length ends to form an integral member.

17. An electrical connector cap as set forth in claim 16, wherein each of said mating portions of said connector and said second connector including a mating channel determined by a pair of opposed side walls having a plurality of male type contact portions of a plurality of contacts disposed along inner surfaces of said opposed side walls, said cap comprising:

at least one projection associated with said mating channel and complementary in shape and size to said mating channel to be received thereinto, and resilient engaging arms to retain each of said connector and said second connector by being engaged with an outer surface of each thereof, said engaging arms being located and engaged with only outermost side walls of said pair of connectors disposed in parallel.

18. An electrical connector cap as set forth in claim 16 wherein each of said mating portions of said connector and said second connector including a projecting portion where a plurality of female type contact portions of said contacts are oppositely disposed in the length, said cap comprising:

each of said pair of cap portions having a top wall and opposed side walls to determine a receiving channel, said opposed side walls having leading ends each with a recess along the outside surfaces thereof to determine a thinner portion, said cap further comprising resilient engaging arms located outside of said outermost side walls.

* * * * *